United States Patent [19]

Moller

[11] Patent Number: 4,756,348

[45] Date of Patent: Jul. 12, 1988

[54] CONTROL APPARATUS FOR PLASTIC BLENDING MACHINERY

[75] Inventor: Richard W. Moller, Fenton, Mich.

[73] Assignee: Hydreclaim Corporation, Fenton, Mich.

[21] Appl. No.: 894,041

[22] Filed: Aug. 7, 1986

[51] Int. Cl.[4] ..... B65B 1/34

[52] U.S. Cl. ..... 141/83; 141/65; 141/128; 251/339; 222/55; 222/457; 222/518

[58] Field of Search ..... 222/53, 56, 55, 457, 222/504, 510, 559, 518, 340; 141/83, 128; 251/155, 156, 339, 398

[56] References Cited

U.S. PATENT DOCUMENTS

| | | | |
|---|---|---|---|
| 368,007 | 8/1887 | Rehn | 222/518 |
| 538,561 | 4/1895 | Upton | 222/518 |
| 1,491,529 | 4/1924 | Haeseler | 222/518 |
| 2,100,550 | 11/1937 | Moore | 251/339 |
| 2,642,206 | 6/1953 | Reed | 222/457 |

*Primary Examiner*—Henry J. Recla
*Assistant Examiner*—Ernest G. Cusick
*Attorney, Agent, or Firm*—Learman & McCulloch

[57] ABSTRACT

Apparatus for controlling the discharge of fluent, particulate plastic material from a supply to a blending hopper comprises a delivery tube having a discharge orifice at its lower end that may be closed by a circular valve which seats against the delivery tube to close and seal the orifice. The valve is movable from its closed position to a fully open position in which a relatively large clearance exists between the discharge orifice and a body of material supported at its angle of repose on the valve. Material thus is able to cascade through the clearance to a receiving hopper whose weight is monitored by one or more load cells coupled to a microprocessor. When the weight of the receiving hopper increases to a selected value due to the delivery of material thereto, the valve is moved from its fully open position to a partially open position in which the aforementioned clearance is reduced substantially, thereby materially slowing the rate of discharge of material from the supply. When a predetermined quantity of material has been delivered to the receiving hopper, the valve is returned to is fully closed position, thereby terminating the discharge of material. The delivery tube has a chamber therein adjacent the discharge orifice that is devoid of material as long as material flows through the discharge orifice, and in which material supported atop the valve may be accommodated when the valve moves to its closed position.

18 Claims, 3 Drawing Sheets

CONTROL APPARATUS FOR PLASTIC BLENDING MACHINERY

This invention relates to apparatus for blending fluent plastic materials in pellet, granular, or shredded form for subsequent discharge to an extruder.

BACKGROUND OF THE INVENTION

Blending machinery for mixing a plurality of different kinds or colors of plastic materials is well known. In such machinery selected quantities of plastic materials are fed from two or more supply hoppers to a receiving or weigh hopper through valve controlled delivery means. The quantities of plastic materials discharged to the weigh hopper are monitored by various mechanisms which function to indicate the approximate amount of such materials present in the weigh hopper.

A major disadvantage of conventional blending machinery of the type just described is the inability thereof to meter accurately the exact quantity of material discharged from each supply hopper. For example, even in those instances in which the sensing means of conventional machinery is operable to detect the delivery of a selected quantity of plastic material to the weigh hopper, there usually is such a time delay between the detection and the termination of delivery that an excess of material is deposited into the weigh hopper. Thus, the quantity of material contained in the weigh hopper rarely, if ever, corresponds to the optimum quantity.

SUMMARY OF THE INVENTION

In an apparatus constructed in accordance with the invention, fluent particulate plastic material, such as pellets, granules, or flakes, is fed from one or more supply hoppers through associated delivery tubes to a weigh hopper and from the latter to a blender hopper, and subsequently to an extruder. The delivery tube of each supply hopper carries a closure sleeve against which a vertically reciprocal valve may seat to effect termination of the discharge of material from the supply hopper to the weigh hopper. Upon command from a microprocessor, the valve may be moved from its closed position to a fully-open, fast-fill position in which the material is discharged through the delivery tube at a maximum flow rate into the weigh hopper.

The quantity of material deposited into the weigh hopper is sensed continuously by one or more conventional load cells or pressure transducers. As the quantity of the material in the weigh hopper approaches a predetermined desired quantity, a signal from a load cell is delivered to the microprocessor to operate a pneumatic control cylinder having a piston rod connected to the valve and which moves the valve to an intermediate, dribble-fill position at which the rate of flow of the material is substantially lessened.

When the desired predetermined quantity of material is sensed in the weigh hopper, a signal from the load cell is delivered to the microprocessor to operate another pneumatic control cylinder and effect immediate closure of the valve. Since the valve moves only a short distance from its dribble-fill position to its closed position, and since the plastic material flows at a substantially slower rate during the final closing movement of the valve, the quantity of material deposited in the weigh hopper corresponds essentially to desired quantity.

Each of the delivery tubes has a frusto-conical nozzle which defines between itself and the closure seal an annular chamber devoid of material during the weigh hopper filling operation, and regardless of whether the valve is in its fast-fill or its dribble-fill position. When the valve is moved from its dribble-fill position to its closed position, any material carried upwardly by the valve into the delivery tube is accommodated within the void of the annular chamber, thereby precluding material packing or jamming.

The blending apparatus also includes at the discharge end of the delivery tube a resilient sleeve against which the valve seats in its closed position and forms a pneumatic seal. The supply hopper may be partially evacuated when its valve is closed so that material discharged from such hopper can be replenished more efficiently than would be the case if the hopper were to be maintained under atmospheric pressure conditions.

BRIEF DESCRIPTION OF THE DRAWINGS

Apparatus constructed in accordance with a preferred embodiment of the invention is disclosed in the following description and the accompanying drawings wherein.

DESCRIPTION OF THE PREFERRED EMBODIMENT

Figure 1:
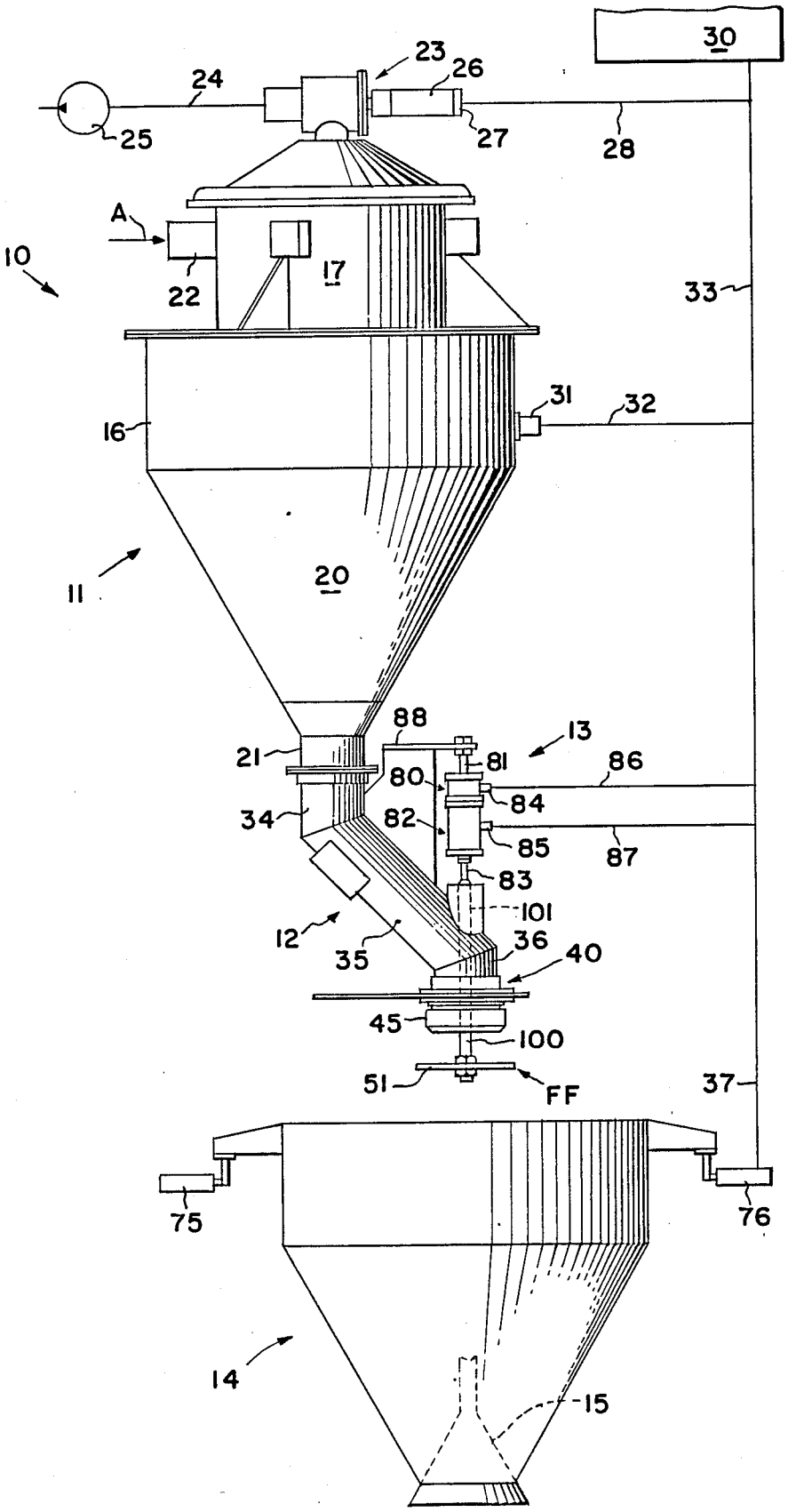
FIG. 1 is a side elevational, partly schematic view of the blending apparatus showing the discharge valve in its fully open position.

Apparatus for regulating the delivery of a quantity of fluent, plastic material, such as polyethylene in pellet, granular, or shredded form, is designated generally by the reference numeral 10 (FIG. 1), and includes a supply hopper 11 having at its lower end a delivery tube or chute 12. A control assembly 13 is provided for regulating the flow of the material through the delivery tube 12 into a weigh hopper 14. The material discharged from the delivery tube 12 accumulates in the weigh hopper 14, as does other material delivered from other supply hoppers and associated delivery tubes (not shown), until a predetermined quantity of the material from each supply hopper 11 has been accumulated in the weigh hopper 14. Thereafter an associated cone or other suitable valve 15 is opened in a conventional manner and the material is successively delivered to an auger-type or other suitable blender hopper (not shown) and thence to an extruder (not shown).

The apparatus 10 has been shown for simplicity as including a single supply hopper 11, its associated delivery tube 12, and its control assembly 13. However, the blending apparatus 10 could include at least one further supply hopper having a corresponding delivery tube and associated control assembly for discharging material into the weigh hopper 14. In a preferred embodiment of the invention there are four supply hoppers 11, each being supplied with a different type and/or color of plastic material, each supply hopper 11 having a delivery tube 12 for discharging material into the same weigh hopper 14, and each supply hopper 11 being controlled by its own control assembly 13. In this manner a predetermined quantity of material can be supplied from any one or all of the supply hoppers 11 into the weigh hopper 14 for eventual extrusion.

The supply hopper 11 includes a relatively large cylindrical wall 16, a smaller cylindrical wall 17 closed by a cover, and a lower frusto-conical wall 20 terminating in a downwardly extending tubular portion 21. The plastic material to be discharged from the supply hopper 11 is delivered via a material inlet 22 (arrow A).

Evacuating means 23 in the form of a known vacuum sequencing atmospheric valve is connected to the cover 18 of the supply hopper 11 for partial evacuation of the latter, as will be described more fully hereinafter, via an evacuating line 24 in response to the operation of a conventional vacuum pump 25. The vacuum sequencing atmospheric valve 23 is operated by means of an air cylinder 26 via a solenoid 27 by signals received over a conductor or line 28 from a conventional microprocessor 30, such as the Series 6150 Microprocessor of HydReclaim Corporation, 3145 Copper Ave., Fenton, Mich. 48430. The purpose of evacuating the supply hopper 11 is to permit the more rapid replenishing of material through the inlet tube 22 than otherwise would be possible if the inlet tube 22 and the supply hopper 11 were maintained under atmospheric pressure conditions. Thus, the material within the hopper 11 can be replenished very rapidly until a predetermined level within the supply hopper 11 is reached, and such level is determined by a conventional material-level sensor 31 which generates appropriate signals that are communicated to the microprocessor 30 via conductors or lines 32,33.

The tubular outlet 21 of the supply hopper 11 is connected via a drop tube 34 to an inclined delivery tube 35 having a vertical tubular end portion 36. The tubular end portion 36 is encircled by a cylindrical sleeve 40 (FIG. 4) having a radial flange 41 which is connected by conventional fasteners, such as nuts and bolts (not shown), to a flange 42 of a tubular outlet ring 43 having a free lower edge 44. A sealing sleeve or cylinder 45 formed of rubber or rubbery material encircles the ring 43 and has a beveled, free lower edge 46 positioned axially below the level of the edge 44 of the ring 43. An outwardly open groove 47 is formed in the sealing sleeve 45 for the accommodation of a conventional clamping band (not shown) which, when tightened, secures the sealing sleeve 45 to the ring 43 in the position best shown in FIG. 4. The terminal edge 46 of the sleeve 45 establishes a discharge orifice or opening O through which the material may flow under certain conditions.

The flow of material through the discharge orifice O is controlled by valve means 50 having a plate 51 of generally circular configuration and a diameter preferably greater than that of the sleeve 45. The valve plate is movable by the control means 13, in a manner presently to be described, from a fully closed position CP (shown in full lines in FIGS. 3 and 4), to a partially open or dribble-fill position DF (shown in full lines in FIGS. 2 and 5), to a fully open or fast-fill position FF (shown in full lines in FIG. 1). In the closed position CP the beveled edge 46 of the sleeve 45 seats upon the flat surface of the valve plate 51 and forms a pneumatic seal therewith for a purpose to be explained more fully hereinafter.

A spout 60 (FIG. 4) has a sleeve 61 secured in any suitable manner to the inner surface of the end portion 36 of the delivery tube 35. The spout is hopper-like in that its side wall converges downwardly. There thus is formed between the spout 60 and the ring 43 an annular chamber 62 the purpose of which will be explained.

The weigh hopper 14 receives material from the hopper 11 when the valve means 50 is in either the dribble-fill DF or the fast-fill FF position. As material is delivered to the weigh hopper 14, sensors in form of known load cells 75, 76 continually monitor the weight of material accumulating within the weigh hopper 14 which is suspended in a known manner so as to move downwardly in response to an increase in the weight of material therein. Electrical signals from the load cells 75 and 76 are transmitted via a conductor 37 to the conductor 33 and thence to the microprocessor 30. In this manner the microprocessor 30 continuously receives signals corresponding to the weight, and hence quantity, of material discharged into the weigh hopper 14 and, through conventional comparative logic circuitry, the microprocessor 30 effects movement of the valve plate 51 from the fast-fill position FF to the dribble-fill position DF when the quantity of the material in the weigh hopper 14 has been sensed to be approaching the total weight of material desired.

The upper surface 52 of the valve plate 51 is flat, as a consequence of which the valve plate can support a quantity of material. Since the material supported atop the valve plate is fluent, such material will assume the angle of repose of such material. The angle of repose is defined as the maximum angle with the horizontal that pulverulent material will retain its position without tending to slide. Assume, for example, that the angle of repose of the material to be discharged from the supply hopper is 45°. This angle of repose is indicated by the reference character AR in FIGS. 4 and 5. The amount of material that can be discharged over the peripheral edge of the valve plate 51 is directly proportional to the clearance between the angle of repose and the free end of the sleeve 45. When the valve plate 51 is in the fully open position FF, the clearance MC (FIG. 4) between the free end 46 of the sleeve 45 and the body of material on the valve plate 51 at the angle of repose is at a maximum. When the valve plate 51 is in the DF position, however, the clearance LC (FIGS. 4 and 5) between such body of material and the free end 46 of the sleeve 45 is less. Accordingly, since the clearance MC is substantially greater than the clearance LC, the flow of material past the valve plate 51 is considerably less when the latter is in the DF position than when in its FF position Once the sensing means 75, 76 senses that the exact quantity of material has been discharged into the weigh hopper 14, the microprocessor 30 initiates movement of the valve means 50 from the dribble-fill position DF to the closed position CP. Such movement of the valve means is relatively fast because the distance between the plate 51 to the lower edge of the sleeve 45 is substantially less than that between the fast-fill position FF and the closed position CP. Furthermore, since the rate of flow of material in the dribble-fill position DF is slower than in the fast-fill position FF, less material proportionally can flow past the valve means 50 between the time that the sensing means 75, 76 senses that the predetermined quantity of material in the weigh hopper 14 has, in fact, been accumulated therein and the time the valve means 50 closes fully. Thus, the slower rate of flow of the material in the dribble-fill position DF, due to the relatively small clearance LC, ensures the accurate delivery of a preselected quantity of the material within the weigh hopper 14.

Figures 4, 5:
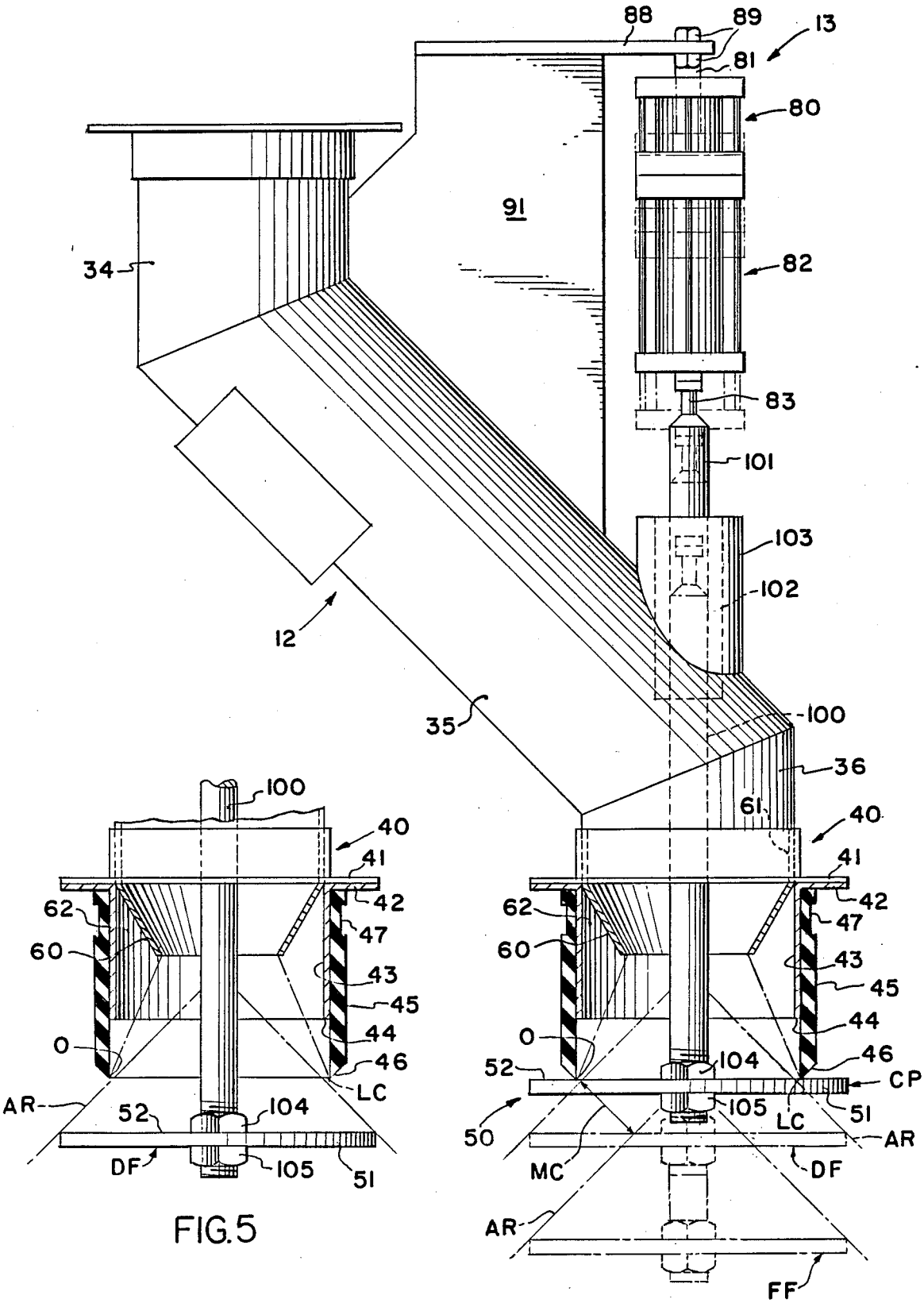
FIG. 4 is a greatly enlarged side elevational view, with parts shown in cross-section, and illustrating the fully open and the dribble-fill positions of the valve in phantom outline.
FIG. 5 is a fragmentary cross-sectional view of the lower portion of FIG. 4 and illustrating the valve in its dribble-feed position.

The control assembly 13 for effecting movements of the valve means 50 is best shown in FIG. 4 and comprises a pair of two-stage control cylinders 80, 82, having respective piston rods 81, 83 connected to and extending from pistons (not shown). The cylinders 80, 82, preferably are pneumatic cylinders of the kind produced by Bimba Manufacturing Company of Monee, Ill., under the trademark FLAT-1, but any double-acting air/hydraulic cylinder will suffice. Each of the cylinders 80, 82 has an inlet (not shown) coupled to a source of pressure fluid in a conventional manner and an exhaust outlet (not shown) controlled by solenoid valves 84, 85 (FIG. 1) operated by the microprocessor 30 via the conductor 33 and conductors 86, 87. The piston rod 81 of the cylinder 80 extends through a horizontal support 88 and is threaded to accommodate a pair of nuts 89 located on opposite sides of support 88. The support 88 forms part of a support gusset that is welded to or otherwise supported by the delivery tube 35 and the drop tube 34. The piston rod 81 has about one-half the stroke of the piston rod 83. In a typical installation the rod 81 has a stroke of one inch and the rod 83 has a stroke of two inches.

The cylinders 80, 82 are welded or otherwise fixed to one another in back-to-back relation, as is best shown in FIG. 4, with the respective rods 81, 83 coaxial and projecting in opposite directions. A generally cylindrical extension rod 100 has its upper end 101 threadedly connected at one end to the rod 83 of the cylinder 82 and has its other end connected to the valve plate 51. The extension rod 100 slideably passes through a suitable bushing or sleeve 102 held immovable within a tubular sleeve 103 that is welded or otherwise secured to the delivery tube 35 (FIG. 4).

The lower end of the extension rod 100 is threaded and slideably passes through an opening in the valve plate 51 which is sandwiched between and has threaded adjusting nuts 104, 105. The nuts 104, 105 permit the valve plate 51 to be adjusted axially of the extension rod 100, whereas the nuts 89 permit adjustment of the stroke of the air cylinder 80. Thus adjustments effect overall adjustment of the total stroke length of the valve plate 51 and the dimensions of the clearances MC and LC.

When the valve plate 51 is in its fully closed position CP, as is best shown in full lines in FIG. 4, the lower edge 46 of the resilient sleeve 45 is in sealing engagement with the upper surface of the valve plate 51. In such position of the valve plate 51 both rods 81, 83 are fully retracted within their respective cylinders 80, 82, as dictated by the microprocessor 30 during the operation of the blending apparatus 10, which operation will be described more fully hereinafter.

In the fast-fill position FF (FIG. 4), both rods 81, 83 are extended fully from their respective cylinders 80, 82. In the dribble-feed position DF (FIGS. 2, 4, and 5), the rod 83 is fully retracted within its cylinder 82, whereas the rod 81 is fully extended from its cylinder 80. Accordingly, and depending upon the positions of the rods 81, 83, the valve plate 51 of the valve means 50 can be moved between and maintained in any selected one of the three positions CP, DF and FF.

TYPICAL OPERATION

Apparatus according to the disclosed embodiment of the invention operates automatically through the microprocessor 30 after a particular blend recipe, i.e., a predetermined desired final weight of the material has been entered therein (or changed from a previous setting) to control the material discharged from the supply hopper 11 into the weigh hopper 14 (along with any other material which similarly is discharged from other supply hoppers into the weigh hopper 14, as was heretofore described). For present purposes it is assumed that the operation of the vacuum pump 25 has been terminated, the vacuum sequenching atmosphere valve 23 is open to atmosphere, an adequate supply of the material is within the supply hopper 11 (as earlier sensed by the material level sensor 31), the valve plate 51 of the valve means 50 is in its closed position CP (FIG. 3), and the discharge valve 15 of the weigh hopper 14 is closed. Although the microprocessor 30 is capable of responding to both flow and weight signals, it is set to respond to weight signals from the load cells 75, 76 via the lines 37, 33.

A start switch (not shown) of the microprocessor 30 is closed to commence the blending process which immediately sends a signal over the lines 33 and 86, 87 to the respective solenoids 84, 85 of the cylinders 80, 82. Pressurized air from a suitable conventional source (not shown) is introduced into the cylinders 80, 82 so as simultaneously to extend the respective rods 81, 83, thereby moving the valve plate 51 via the extension rod 100 from its closed position CP (FIG. 3) to its fast-fill position FF (FIGS. 1 and 4). The material then may flow by gravity from the supply hopper 11 through the delivery tube 12 and the nozzle 60 and impinge upon the flat upper surface 52 of the plate 51.

A body of material will accumulate on the upper surface of the valve plate and spread outwardly over the periphery of the latter until the angle of repose is reached. Thereafter, additional material discharged from the nozzle 60 will cascade over the edge of the plate 51. The cascading material will occupy completely the clearance MC between the body of material on the valve plate and the lower edge 46 of the sleeve 45 and such material will flow past the valve plate into the weigh hopper 14. Thus, the material flows relatively rapidly into the weigh hopper 14 when the valve plate 51 is in the fast-fill position FF during which time, of course, the weight of the material within the hopper 14 is monitored continuously by the sensing means 75, 76.

Figure 2:
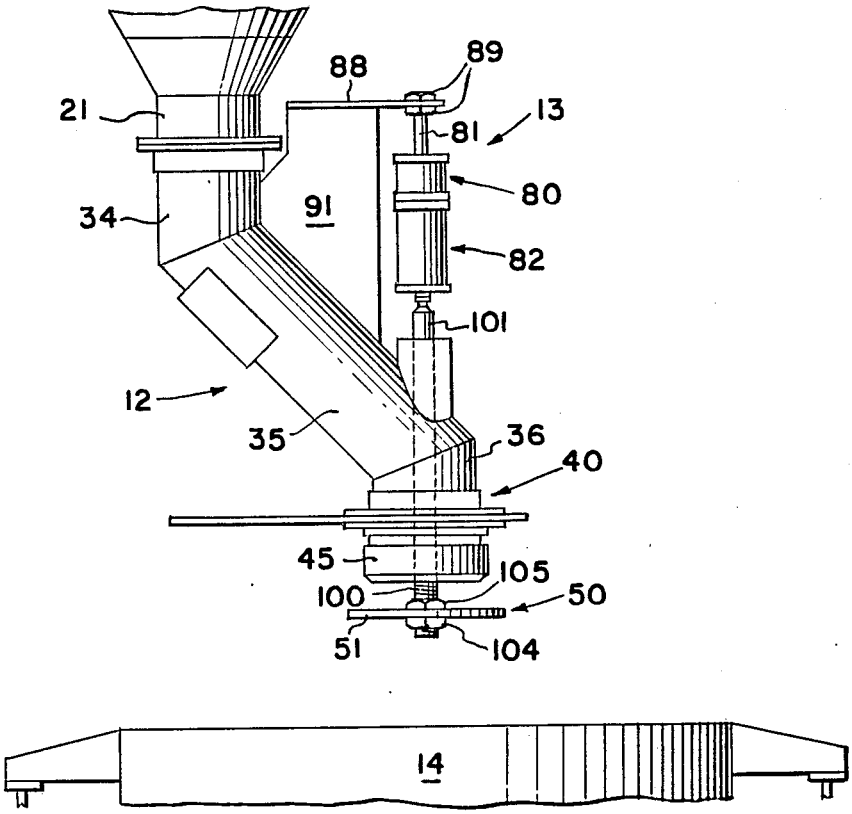
FIG. 2 is a fragmentary, side elevational view of a portion of the blending apparatus of FIG. 1, but on a larger scale, and illustrating the discharge valve in an intermediate dribble-fill position relative to the discharge orifice of the delivery tube.
Figure 3:
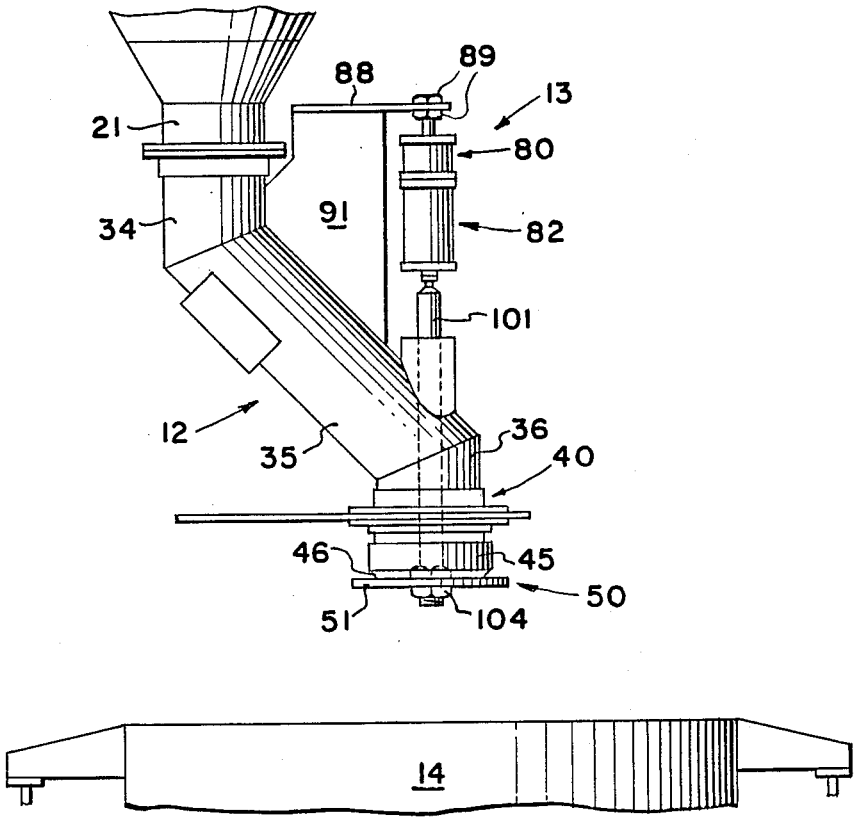
FIG. 3 is a view similar to FIG. 2, but illustrating the valve in its fully closed position.

As the weight of material discharged to the hopper 14 approaches the predetermined desired quantity earlier programmed into the microprocessor 30, a signal from the latter is transmitted via the lines 33, 87 to the solenoid 85 of the cylinder 82. Pressure fluid introduced into the cylinder 82 retracts the piston rod 83 into the cylinder 82 thereby moving the valve plate 51 from the fast-fill position FF to the dribble-fill position DF (FIG. 2). In this position the valve plate 51 is moved closer to the lower edge 46 of the sleeve 45 thereby establishing the smaller clearance LC between the body of material at the angle of repose on the valve plate and the lower edge of the sleeve 45. Since the clearance LC is substantially less than the clearance MC, the material which cascades past the valve plate 51 is substantially less than that which flows through the clearance MC. Thus, the rate of material flow when the valve means 50 is in the double-fill position DF is substantially less than that when the valve means is in its fast-fill position FF.

When the weight of the material discharged to the weigh hopper 14 approaches the predetermined desired quantity, another signal generated by the sensors 75, 76 effects operation of the solenoid 84 associated with the cylinder 80 via the lines 33, 86 to retract the rod 81 into the cylinder 80 thereby moving the valve plate 51 from the dribble-feed position DF to the closed position CP. Since the valve plate 51 need move but a short distance from the dribble-fill position DF to the closed position CP, and since during this movement the rate of flow of the material is relatively slow, the final quantity of material discharged to the weigh hopper 14 is virtually identical to the predetermined quantity desired.

As the valve plate 51 is moved toward the closed position CP from the dribble-fill position DF, some of the material supported on the valve plate 51 necessarily will be moved upwardly and into the sleeve 45 and the ring 43. Such material may be accommodated in the annular chamber 62 which is devoid of material when the valve means 50 is open. Inasmuch as whatever material supported upon the valve plate 51 is accommodated in the annular chamber 62, slowing of closing movement of the valve means and material jamming or packing which otherwise might occur in the absence of the annular chamber 62 are totally prevented. Hence, upon the subsequent reopening of the valve plate 51 from the closed position CP, the material immediately will commence its discharge from the supply hopper.

During the discharging operation just described, the quantity of material within the supply hopper 11 is depleted to some extent. The supply should be replenished before the next discharge operation. This conveniently may be accomplished while the valve plate 51 bears against the lower edge of the sleeve 45 and forms a seal therewith. Due to the presence of the seal the entire supply hopper 11 and delivery tube 12 can be subjected to a partial vacuum by the vacuum pump 23 upon the operation of the vacuum sequencing atmospheric valve 26.

To evacuate the hopper 11 a signal is transmitted to the solenoid 27 via the lines 28, 33 from the microprocessor 30 which, by means of the cylinder 26, shifts the valve 23 to close off communication with atmosphere and open the interior of the supply hopper 11 to the evacuating line 24. Under such partial vacuum, fresh material rapidly may be conveyed into the supply hopper 11 through the evacuated inlet tube 22. Since the introduction of material to the supply hopper 11 is not resisted by atmospheric pressure, the supply hopper 11 rapidly may be filled to the height sensed by the material level sensor 31. The material level sensor 31 transmits a signal via the lines 32, 33 to the microprocessor 30 which in turn sends a signal via the lines 33, 28 closing the valve 23 to the vacuum pump line 24 and opening the valve 23 to atmosphere to reestablish atmospheric pressure conditions within the supply hopper 11 for subsequent discharge of the material therefrom.

During the supply hopper recharging cycle just described, the material in the weigh hopper 14 can be discharged to the blender hopper (not shown) by simply manually or automatically opening the valve 15. Once the material has been discharged from the weigh hopper 14, the valve 15 again is closed and the blending apparatus 10 is reconditioned for another cycle of operation depending, of course, upon the particular recipe or recipes entered into the microprocessor 30.

In the operations just described, it was assumed that the blending apparatus 10 included only the single supply hopper 11 discharging its material into the weigh hopper 14. However, in actual practice a plurality of additional supply hoppers, like the supply hopper 11, are associated with a single weigh hopper 14 and these supply hoppers discharge their materials successively into the weigh hopper 14. Thus, after the predetermined quantity of material from one supply hopper has been deposited into the weigh hopper 14 and the valve means 50 thereof has been closed, the next supply hopper is activated to discharge its material into the weigh hopper 14 until the predetermined quantity of this second material is discharged. Such sequential blending process is continued until all desired materials from all supply hoppers have been deposited in the weigh hopper 14. Once all of the materials have been deposited in the weigh hopper 14, the valve 15 is opened and the materials fed to the blender hopper for subsequent auger-type or other blending and feeding to the extruder.

In those cases in which a plurality of supply hoppers are used with their associated discharge tubes, control assemblies, and valves, it may be preferable to include a vacuum manifold between the pump 25 and the lines 24 connected to the vacuum sequencing atmospheric valves 23 of all of the supply hoppers, as opposed to connecting each individually to an individual vacuum source or vacuum pump 25.

Since the plastic materials can vary in size, shape, coefficient of friction, moisture content, and the like, it is desirable to be able to alter the dimensions of the clearances LC and MC in both the dribble-feed position DF and the fast-feed position FF of the valve means 50. Adjustment of the fast-feed position is accomplished by adjusting the valve plate 51 axially of the rod 100 by axial adjustment of the nuts 104, 105 (FIG. 4). Adjustment to alter the dribble-feed position DF is accomplished by axially adjusting the position of the rod 81 relative to the support 88 by means of the nuts 89 as will be apparent from FIGS. 2 and 4 of the drawings. Thence fine adjustments additionally ensure that the material deposited in the weigh hopper 14 is corresponds to the predetermined quantity programmed into the microprocessor 30.

This disclosure is representative of a preferred embodiment of the invention, but is intended to be illustrative rather than definitive thereof. The invention is defined in the claims.

What is claimed is:

1. Apparatus for controlling the flow of fluent material from a material supply to a receiver, said apparatus comprising a generally vertical delivery tube having a discharge orifice at its lower end; a valve underlying said orifice and being of such area as to provide support for said material at its angle of repose and to close said orifice; means mounting said valve for substantially vertical movements toward and away from said orifice, said valve being movable from a fully open position in which a clearance exists between said orifice and material supported at its angle of repose on said valve through which material may flow into said receiver and a closed position in which said orifice is closed; sensing means coupled to said receiver for sensing an increase in the quantity of material in said receiver; and operating means coupled to said sensing means operable in response to the sensing of a predetermined increase in the quantity of material in said receiver to move said valve from said fully open position to an intermeidate open positoin between said fully open position and said closed position and reduce said clearance, thereby reducing the rate of flow of material through said clearance to said receiver, said operating means also being operable in response to the sensing of a further predetermined increase in the quantity of material in said receiver to move said valve from said intermediate position to said closed position.

2. Apparatus according to claim 1 including means for partially evacuating said material supply when said valve is in said fully closed position.

3. Apparatus according to claim 1 including means within said delivery tube adjacent said discharge orifice defining a chamber devoid of material when material flows through said discharge orifice, said chamber having a volume sufficient to accommodate material supported on said valve when the latter moves to its closed position.

4. Apparatus according to claim 1 wherein said operating means includes fluid cylinder means coupled to said valve for moving the latter..

5. Apparatus according to claim 1 including a resilient member encircling said discharge orifice and located in a position to engage said valve and form a seal therewith when the valve is in its closed position.

6. Apparatus according to claim 5 including means for partially evacuating said material supply when said valve means is in sealing engagement with said resilient member.

7. Apparatus according to claim 1 wherein said delivery tube has a peripheral edge defining said discharge orifice, and a spout within said delivery tube, said tube and said spout having an annular chamber therebetween devoid of material when material flows through said discharge orifice.

8. Apparatus according to claim 7 wherein said spout has a frusto-conical wall converging in a direction toward said valve.

9. Apparatus according to claim 7 wherein said annular chamber is of such volume as to accommodate material supported on said valve when the latter moves to its closed position.

10. Apparatus according to claim 1 wherein said operating means includes a pair of fluid pressure cylinders, means for operating a first one of said pair of cylinders to move said valve from said fully open position to said intermediate open position and for operating the second one of said pair of cylinders to move said valve from said intermediate open position to said closed position.

11. Apparatus according to claim 10 wherein each one of said cylinders includes a piston rod, means for securing said cylinders to each other with the piston rods thereof aligned and extending in opposite directions, means for connecting one of said piston rods to a support, and means for connecting the other of said piston rods to said valve.

12. Apparatus according to claim 1 wherein said operating means comprises a pair of fluid pressure cylinders, and means for actuating only one of said pair of cylinders to move said valve from the fully open position to the intermediate open position and additionally for actuating the other of said pair of cylinder means to move said valve from the intermediate open position to the closed position.

13. Apparatus according to claim 1 including means for adjusting said clearance.

14. Apparatus according to claim 1 wherein the area of said valve is greater than that of said orifice and wherein said valve projects beyond the periphery of said orifice.

15. Apparatus according to claim 1 wherein said orifice is circular, said valve is circular, and the diameter of said valve is larger than that of said orifice, said valve projecting circumferentially a uniform distance beyond said orifice.

16. Apparatus according to claim 1 including means for adjusting said valve member relative to said mounting means toward and away from said orifice to vary the size of said clearance.

17. Apparatus for controlling the flow of fluent, particulate material through a vertical tube having a discharge orifice at its lower end, said apparatus comprising a valve having a surface adapted to support material thereon at its angle of repose and to seat against said tube and close said discharge orifice and thereby prevent material from flowing therethrough, means for moving said valve upwardly to its closed position from an open position in which said valve surface is spaced below said discharge orifice, and a spout within said tube through which material flows into said tube, said spout having an outlet spaced inwardly from said tube and forming with the latter an annular chamber devoid of material when said valve is in said open position, said annular chamber being of sufficient capacity to accommodate material supported on said valve surface by permitting said material to expand into said annular chamber when said valve is moved from its open position to its closed position, thereby facilitating closing of said valve and preventing jamming or packing of said material in said discharge orifice.

18. Apparatus according to claim 17 wherein said spout has a frusto-conical wall converging in a direction toward said valve.

* * * * *